US006918590B2

(12) United States Patent
Annis et al.

(10) Patent No.: US 6,918,590 B2
(45) Date of Patent: Jul. 19, 2005

(54) FIGURE WITH SPINNER IN BASE

(75) Inventors: Robert E.G. Annis, Park Ridge, IL (US); Hiram P. Johnson, Chicago, IL (US); Donald A. Rosenwinkel, Oak Park, IL (US)

(73) Assignee: Big Monster Toys L.L.C., Chicago, IL (US)

( * ) Notice: Subject to any disclaimer, the term of this patent is extended or adjusted under 35 U.S.C. 154(b) by 33 days.

(21) Appl. No.: 10/740,308

(22) Filed: Dec. 18, 2003

(65) Prior Publication Data

US 2004/0198161 A1 Oct. 7, 2004

Related U.S. Application Data

(60) Provisional application No. 60/434,339, filed on Dec. 18, 2002.

(51) Int. Cl.[7] ..... A63F 3/00

(52) U.S. Cl. ..... 273/289; 273/288; 273/242 R; 273/242 H; 273/242 K

(58) Field of Search ..... 273/289, 288, 273/242 R, 242 H, 242 K

(56) References Cited

U.S. PATENT DOCUMENTS

| | | | | | |
|---|---|---|---|---|---|
| 88,756 | A | * | 4/1869 | Trump | 273/141 R |
| 599,452 | A | * | 2/1898 | Mitchell | 273/244.1 |
| 1,409,033 | A | * | 3/1922 | Smiley | 273/244.1 |
| 2,435,885 | A | * | 2/1948 | Gewirtzman | 273/142 R |
| D244,559 | S | * | 5/1977 | Wells et al. | D21/374 |
| 4,687,199 | A | * | 8/1987 | Aguirregomezcorta | 273/244.2 |
| 5,310,190 | A | * | 5/1994 | Morris | 273/243 |
| 2003/0071414 | A1 | * | 4/2003 | Weisman | 273/236 |
| 2004/0051244 | A1 | * | 3/2004 | Weisman | 273/262 |

FOREIGN PATENT DOCUMENTS

| | | | | | |
|---|---|---|---|---|---|
| ZA | 8809160 | A | * | 2/1990 | A63F/0/00 |

* cited by examiner

*Primary Examiner*—Derris H. Banks
*Assistant Examiner*—Urszula M. Cegielnik
(74) *Attorney, Agent, or Firm*—John S. Pacocha

(57) ABSTRACT

A toy figure, such as a baseball player, which may or may not represent an actual identifiable person, is mounted upon a cylindrical base. Carried in the base is a rotatable disk having a grooved, serrated, knurled or otherwise textured outer peripheral wall. An arcuate access opening in the side wall of the base exposes a segment of at least the textured peripheral wall facilitating spinning or rotation of the disk by the user's thumb or finger. On the upper face of the disk, as disposed in the base, are a number of sectors, each of which contains indicia for determining an outcome in the play of a game. A viewing opening in the upper surface of the base permits viewing of a single sector on the disk. The underside of the disk has a series of radial grooves and/or ridges forming a face ratchet that cooperate with an upwardly biased pawl on the upper, inside surface of the bottom wall of the base to provide for the viewing of just one of the sectors on the upper surface of the disk through the viewing opening in the base.

20 Claims, 1 Drawing Sheet

Fig 1
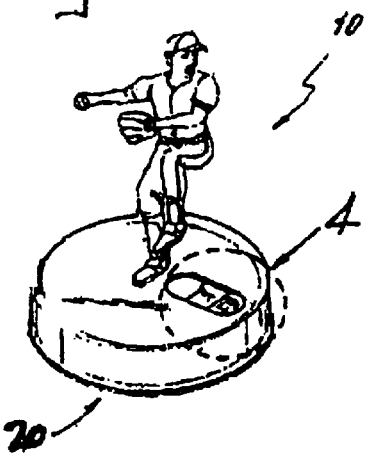
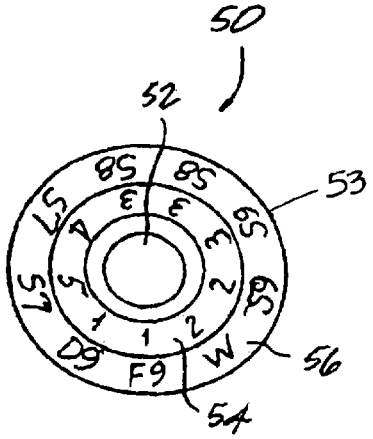
Fig. 3
Fig. 2
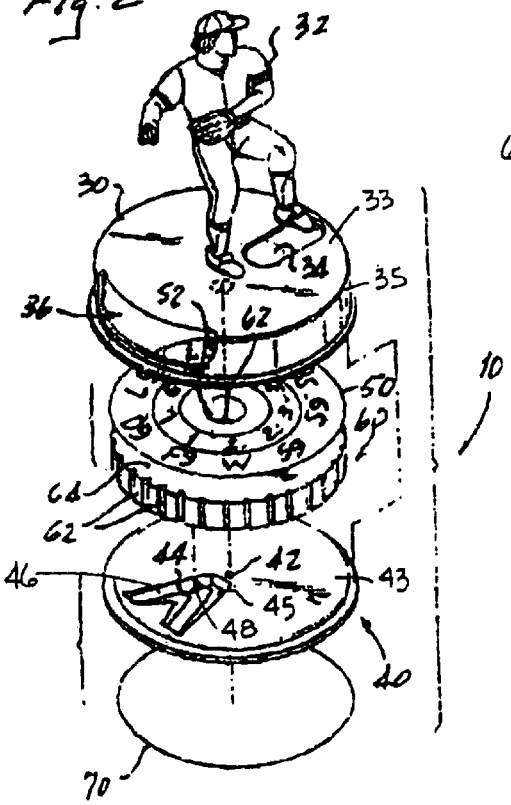
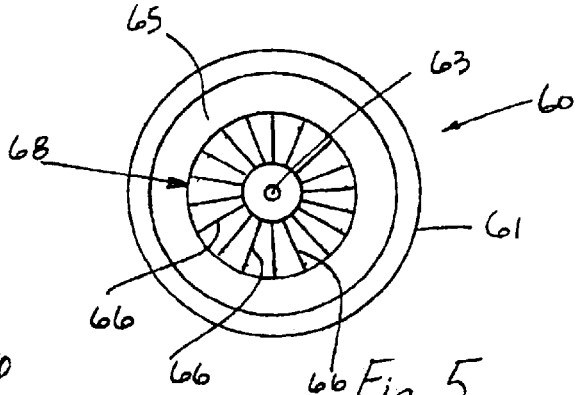
Fig. 5
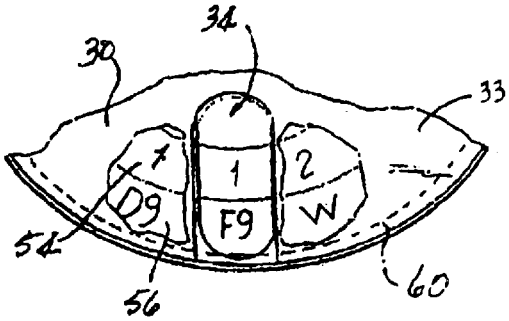
Fig. 4

FIGURE WITH SPINNER IN BASE

RELATED APPLICATION

This Application claims the benefit of U.S. Provisional Patent Application No. 60/434,339 filed on Dec. 18, 2002.

BACKGROUND OF THE INVENTION

1. Field of the Invention

This invention relates generally to toy figures and more particularly to toy figures that can be used for playing a game.

2. Background Art

Figures of characters have long been used in the play of various games. For example, in chess, figures of characters are the actual playing pieces, each of which is movable and imbued with certain characteristics and powers. As a less structured example, toy soldiers have been used to play mock war games. Toy figures have also been used as tokens to mark a player's progress around the path of a board game. Many games also involve the use of a chance determiner, such as a overturned card, a thrown die, or a spinner.

The use of figures in playing a game involving a spinner as a chance determiner is shown in Trump, U.S. Pat. No. 88,756 issued Apr. 6, 1869, Wells et al., U.S. Pat. No. 3,224,772 issued Dec. 21, 1965, and Kraus, U.S. Pat. No. 5,390,933 issued Feb. 21, 1995. The Trump patent discloses a parlor game involving the use of an upright figure on the center of a cylindrical base with a rotatable card or plate received on the base, around the bottom of the figure. A lever extending out the side of a disk is moved to engage a gear within the base, causing rotation of the card or plate. Atop the card or plate are a number of sectors having indicia of various outcomes. The figure mounted atop the base holds a pointer. Ideally, when the rotating card comes to a stop, the figure points to one of the outcome sectors. However, all of the sectors on the rotatable card of the Trump parlor game are always exposed to view, and there is nothing to avoid "liners".

The Wells et al. patent discloses a baseball game having a number of figures representing the batter, pitcher, catcher and fielders, each of which is attached to a disk. On the upper surface of each disk are a number of radial sectors containing indicia for determining outcome in the game. In addition to some of the other mechanical aspects, manual rotation of a pointer relative to the sectors on a particular player's disk is used to determine outcome.

The Kraus patent discloses collectible cards on which various game results are displayed in sectors in a ring around a two dimensional representation of a baseball player. The card is then inserted into a transparent sleeve having a rotatable pointer, which is then manually spun to determine an outcome in the play of a baseball game. There remains a need for a three dimensional toy figure with a spinner chance determiner that can be used in the play of various games and which avoids indeterminate positions, or "liners," and may obscure at least some of the selections available prior to operation of the spinner.

SUMMARY OF THE INVENTION

The present invention is concerned with providing a toy figure for use in playing a game comprising a figure representing a character appropriate to the game to be played. The figure is mounted upon a base having an upper surface, an opposed bottom wall, and at least one side wall extending at least partially between the upper surface and the bottom wall, which has an upper inside surface. There is an access opening in the side wall of the base. A rotatable disk is substantially contained within the base. The disk has an upper face, as the disk is disposed in the base, an opposed underside, and an outer peripheral wall extending at least partially between the upper face and the underside. A segment of at least the peripheral wall is exposed in the access opening in the side wall facilitating spinning or rotation of the disk by the user's thumb or finger. There are a number of sectors on the upper face of the disk; at least some of the sectors having indicia for determining an outcome in the play of the game. A viewing opening or window in the upper surface of the base permits viewing of the entirety of only a single sector on the disk. The underside of the disk has a face ratchet, and an upwardly biased pawl on the upper, inside surface of the bottom wall of the base cooperates with the face ratchet to provide for the viewing of the entirety of only one of the sectors of the disk through the viewing opening in the upper surface of the base.

BRIEF DESCRIPTION OF THE DRAWINGS

For a better understanding of the present invention, reference may be had to the accompanying drawings in which:

FIG. 1 is a perspective view of an embodiment of the present invention;

FIG. 2 is an exploded, perspective view of the embodiment shown in FIG. 1, rotated approximately ninety (90°) degrees;

FIG. 3 is a top view of an upper decal on a disk or spinner according to the present invention;

FIG. 4 is a partial enlarged, fragmentary top view of the portion of the base designated by the broken line circle and reference 4 in FIG. 1; and FIG. 5 is a bottom view of the disk or spinner shown in FIG. 2.

DETAILED DESCRIPTION

The present invention relates to the field of games, and in particular to games which simulate an activity, sport, or game in which recognizable characters participate. Thus, in the illustrated embodiment, the toy figure 10 is representative of a pitcher in a baseball game, and may further represent a particular, identifiable pitcher by various indicia such as the style and coloration of the uniform worn by the figure, an identifying number and/or name on the uniform, and/or a name or other identifying indicia on the base 20 on which the figure is mounted, or even upon an associated card (not shown). A number of similarly constructed, though differently styled and/or posed figures may be provided to simulate the various members of a side or team that normally participate in the real life activity, sport or game. Thus, in an example of a baseball game, an entire team of figures representing all nine of the defensive positions may be provided, along with corollary figures in the offensive batting position, as well as a tenth figure representing a designated hitter. It will be readily appreciated by those skilled in the art that similar sets of figures may be provided for other sports, and even fantasy war games.

The basic rules of the game to be played may readily be based upon the rules of the actual game or sport, such as baseball. A game to be played using the toy figures of the present invention may also include a game board, a score sheet, and may also possibly include cards or tables providing for more advanced and complex play involving strategies and tactics pitting teams, and even individual players against each other. A game board or mat may reflect unique characteristics of a particular team's home field or stadium, and may itself have provisions for a scorecard/scoreboard, and various statistics and probabilities. Particularly where the toy figures are representative of a real life player, variations of the toy figure may be provided to reflect the player's performance at different positions, such as, for example, a utility baseball player's performance at different defensive positions or a football player's performance in the player's regular offensive or defensive position, as well as on a special team. Each such character's various skills, such as that of a baseball player's probability of hitting singles, doubles, triples, homeruns, pop-ups, long fly balls, or striking out, may be used to determine play of the game. For example, a homerun slugger could have more homeruns and strikeouts sectors, and less singles and pop-ups sectors. Variations of such a toy figure could also be provided to reflect the real life player's change in skill levels at different times in the player's career.

Referring now to the drawings in which like reference numerals are used for designating like parts throughout the several views, there is shown in FIG. 1 a toy figure 10 having a base 20 according to the present invention. FIG. 2 is an exploded view of the toy figure 10 according to the present invention. Base 20 of toy figure 10 can comprise an upper shell 30 and a bottom wall or plate 40, which is secured to the upper shell 30 by a friction fit, a suitable adhesive, or ultrasonic welding. A rotatable disk, dial, or spinner 60 is provided, in base 20 between upper shell 30 and bottom wall 40.

An upper pin 62 on the disk 60 is received in an upper socket (not shown) on the underside of upper shell 30. In addition, a lower pin 63 on the disk 60 is received in a lower socket 42 in bottom wall 40. Pins 62 and 63 are substantially co-axial and serve as trunnions or stub axles. Thus disk 60 is carried in base 20 for rotation or spinning about the axis of pins 62 and 63.

An upper decal 50 is affixed to the upper surface 64 of the disk 60. FIG. 3 shows an example of an upper decal 50 according to the present invention. Upper decal 50 includes a center opening 52 so that upper pin 62 of disk 60 can connect to the upper socket of upper shell 30. Radial sectors 53, of which there are nine in the example illustrated in FIG. 3, on upper decal 50 can be marked with various types of indices that may be determinative of the play of the game. In a game to be played with basic rules, there may only be a single ring of indices representing the possible outcomes that may result based on the particular character or player represented, the position of that character or player, and whether the character or player is represented to be on offense (batting in a baseball game) or on defense. Alternatively, as illustrated in FIG. 3, there may be an inner ring of indices 54, and an outer ring of indices 56. Each index of inner ring 54 of indices as shown in FIG. 3 comprises a single number, while each index of outer ring 56 of indices as shown in FIG. 3 comprises a combination of a single number and letter. However, an index of the outer ring 56 could comprise a single letter.

FIG. 4 shows an enlarged, partial, fragment of upper shell 30 of FIG. 1. The upper surface 33 of upper shell 30 is provided with a radially elongated viewing opening or window 34 through which the entirety of only one inner index from the inner ring of indices 54 and the entirety only one outer index from the outer ring of indices 56 appear. The outer peripheral wall 35 of upper shell 30 is provided with an access opening 36 through which the player's finger or thumb (not shown) can spin disk 60.

A figure of a character 32 is mounted on upper surface 33 of upper shell 30, as shown in FIGS. 1–2. Character 32 can be made in the image of the particular recognizable character or player that the toy figure 10 represents. The character may be pivotally mounted on base 20, or it may be mounted in a fixed orientation, having a forward facing direction as illustrated. Viewing opening or window 34 is oriented in the same forward facing direction of figure 32, while access opening 36 is generally opposite.

A tactile or textured surface 62, such as a surface having a plurality of grooves, serrations, or knurling is provided on the outer peripheral wall or surface 61 of disk 60. Textured surface 62 facilitates a player's finger or thumb more easily gripping the outer peripheral wall surface of disk 60 for spinning.

On bottom plate 40 of base 20, there is an upwardly biased pawl or detent 44 that cooperates with circumferential grooves 66 forming a face ratchet 68 on underside 65 of disk 60, as shown in FIG. 5. As illustrated in FIG. 2, pawl 44 is formed as an integral part of base 20, or more particularly bottom wall 40, which is made of plastic. However, pawl 44 could be a separate component mounted on the upper, inside surface 43 of bottom wall 40. As illustrated in FIG. 2, pawl 44 is formed in a cut-out portion 45 of bottom wall 40, and has a thin, upwardly canted, inverted V-shaped leaf 46. On the top of the free end of leaf 46 is a radial rib or projection 48.

Pawl 44 provides a positive stop of disk 60 in one of a preselected number of radial positions in order to show the entirety of only one of sectors 53 containing an inner index from the inner ring of indices 54 and an outer index from the outer ring of indices 56 appearing in window opening 34, to facilitate the elimination of "liners". A series of circumferential grooves 66 are provided at predetermined locations on the underside 65 of disk 60, and correspond in number to the number of sectors 53. The bottom of one of each of grooves 66 aligns with the radial center of one of sectors 53. As an alternative, ridges rather than grooves 66 may be used to comprise face ratchet 68. Rib or projection 48 of the pawl engages grooves 66 to bring disk 60 to a stop in a position such that the entirety of only one inner index from the inner ring of indices 54 and the entirety only one outer index from the outer ring of indices 56 appear in viewing opening or window 34.

A lower decal 70 can be affixed to the underside of bottom wall 40. Lower decal 70 can include additional information relating to a character or player such as a name, a position name, a position number, and a player cost. In a baseball game played using the present invention, each team could include a set of ten toy figures. Each team could include a toy figure for each of the nine positions: pitcher (1), catcher (2), first baseman (3), second baseman (4), third baseman (5), shortstop (6), left fielder (7), center fielder (8), and right fielder (9). A toy figure for a designated hitter (DH) may also be included. Each toy figure may have a player cost marked. The cost of the entire team may be required to equal, or be less than, some pre-selected amount.

After the particular toy figures have been selected to fill a team, and the batting line-ups have been determined, the toy figures may be placed at their positions on a game board. The home team begins the game on defense, and therefore, the home team places the pitcher toy figure on the pitcher's mound. In a very basic game the outcome of a pitch may simply be determined by the letters in outer index 56, as for example:

S for a single when the batter is moved to first base, and all of the runners that may be on base advance one base;

D for a double when the batter is moved to second base, and all of the runners that may be on base advance two bases;

T for a triple when the batter is moved to third base, and all of the runners that may be on base score;

H for a homerun when the batter and all of the runners that may be on base score;

K for a strike out when the batter spinner strikes out and none of the runners that may be on base advance;

W for a walk when the batter is moved to first base, and the runners that may be on base do not advance unless forced by the batter being moved to first;

F for a flyball out when the batter is out and the runners that may be on base do not advance;

P for a popup when the batter is out and the runners that may be on base do not advance; and G for a ground out when the batter hits a ground ball; the batter is out and the runners that may be on base do not advance if no runner is on first base. If a runner is on first base, then that runner on first base is out at second base and the batter is safe at first base on a fielder's choice.

Normal baseball rules apply, and therefore, each team gets three outs per inning and the game lasts nine innings.

In a more advanced game, the numbers forming part of the outer ring of indices may be taken into account to determine further variations of the outcome in combination with toy figures representing defensive players, or by some sort of chart or table. Thus, for example, "F9", a fly out to the right fielder, may result in a runner on a base advancing, or even scoring from second base, depending on the skills of the right fielder. Even more advanced games, with further variations, may be played employing the inner ring 54 of indices. Thus, when a toy figure is used for the defensive player, such as a second baseman, and the batter hits a ground ball to the second baseman, a spin-off between the batter and the second baseman toy figures may be used to determine whether there is a double play or a runner on third scores. Alternatively, such inner ring indices may be used with a chart or table to determine other results. Even more possibilities and variations may result from color coding the indices.

While particular embodiments of the invention have been shown and described, with some further suggested alternatives, further variations and modifications will occur to those skilled in the art. It is intended in the appended claims to cover all such variations and modifications that come within the true spirit and scope of the present invention.

What is claimed as new and desired to be secured by Letters Patent is:

1. A toy figure for use in playing a game comprising:

a figure representing a character appropriate to the game to be played;

a base upon which the figure is mounted;

the base having an upper surface, an opposed bottom wall, and at least one side wall extending at least partially between the upper surface and the bottom wall;

the bottom wall having an upper, inside surface;

an access opening in the side wall of the base;

a rotatable disk substantially contained within the base;

the disk having an upper face, as the disk is disposed in the base, an opposed underside, and an outer peripheral wall extending at least partially between the upper face and the underside;

a segment of at least the peripheral wall being exposed in the access opening in the side wall facilitating spinning or rotation of the disk by the user's thumb or finger;

a number of sectors on the upper face of the disk;

at least some of the sectors having indicia for determining an outcome in the play of the game;

a viewing opening in the upper surface of the base permitting viewing of the entirety of only a single sector on the disk;

the underside of the disk having a face ratchet;

an upwardly biased pawl on the upper, inside surface of the bottom wall of the base; and the upwardly biased pawl on the upper, inside surface of the bottom wall of the base cooperating with the face ratchet to provide for the viewing of the entirety of only one of the sectors on the upper surface of the disk through the viewing opening in the upper surface of the base.

2. The toy figure of claim 1 in which the figure represents an actual identifiable person.

3. The toy figure of claim 2 in which the figure is mounted on the base in a fixed orientation.

4. The toy figure of claim 3 in which the figure is in a fixed orientation having a forward direction.

5. The toy figure of claim 4 in which the access opening in the side wall of the base is substantially opposite the forward direction of the figure.

6. The toy figure of claim 5 in which the viewing opening in the upper surface of the base of the base is substantially opposite the access opening in the side wall of the base.

7. The toy figure of claim 4 in which the viewing opening in the upper surface of the base of the base is substantially aligned with the forward direction of the figure.

8. The toy figure of claim 1 in which the figure is a three dimensional representation of the character.

9. The toy figure of claim 1 in which the base is substantially cylindrical.

10. The toy figure of claim 9 in which the access opening in the side wall of the base is arcuate.

11. The toy figure of claim 1 in which the outer peripheral wall is textured.

12. The toy figure of claim 11 in which the textured outer peripheral wall is grooved.

13. The toy figure of claim 12 in which the textured outer peripheral wall has grooves extending substantially from the upper face to the underside.

14. The toy figure of claim 11 in which the textured outer peripheral wall is serrated.

15. The toy figure of claim 11 in which the textured outer peripheral wall is knurled.

16. The toy figure of claim 1 in which the face ratchet is formed of a series of radial grooves.

17. The toy figure of claim 1 in which:

the number of sectors on the upper face of the disk are predetermined; and the series of grooves is of the same predetermined number as the predetermined number of grooves.

18. The toy figure of claim 1 in which the face ratchet is formed of a series of radial ridges.

19. The toy figure of claim 1 in which the pawl is an integral part of the bottom wall.

20. The toy figure of claim 1 in which the pawl includes:

a thin, upwardly canted, leaf having a free end; and a radial rib on the free end of the leaf.

* * * * *